United States Patent [19]

Polansky

[11] 4,093,129

[45] June 6, 1978

[54] MACHINE TO COMMINUTE REFUSE

[75] Inventor: Henry J. Polansky, Buffalo, Minn.

[73] Assignee: Tire Recycling of Minnesota, Inc., Shoreview, Minn.

[21] Appl. No.: 760,365

[22] Filed: Jan. 19, 1977

[51] Int. Cl.[2] ..... B02C 13/06

[52] U.S. Cl. ..... 241/186 R; 241/190; 241/294; 241/DIG. 31

[58] Field of Search ..... 241/186 R, 190, 223, 241/243, 294, DIG. 31

[56] References Cited

U.S. PATENT DOCUMENTS

| | | | |
|---|---|---|---|
| 945,496 | 1/1910 | Dittbenner | 241/243 X |
| 2,159,363 | 3/1940 | Fegley et al. | 241/243 X |
| 2,854,047 | 9/1958 | Schmidt, Jr. | 241/294 X |
| 2,957,508 | 10/1960 | Mason | 241/223 X |
| 3,151,814 | 10/1964 | Morgan et al. | 241/190 X |

*Primary Examiner*—Roy Lake
*Assistant Examiner*—Howard N. Goldberg
*Attorney, Agent, or Firm*—Burd, Braddock & Bartz

[57] ABSTRACT

A machine to comminute refuse includes a drum-like rotor on a rotor axle inside a housing. The rotor includes two face-to-face outwardly diverging part-conical discs each supporting a plurality of shear plates which have spaced-apart teeth along outer edges thereof. The teeth of each shear plate lie in a plane which includes the axis of said rotor and extends radially outwardly therefrom. An anvil in said housing also has spaced-apart teeth positioned to be in intermeshing relation to the shear plate teeth as the shear plates rotate with the rotor. Rubbish to be comminuted is fed into the machine at position directly above the axle of the rotor and is carried by the shear plates and shear teeth into contact with the anvil and anvil teeth, shearing off the portions of the refuse aligned with the shear plate teeth and carrying this refuse through to position under the rotor where it is discharged vertically from the machine.

4 Claims, 5 Drawing Figures

FIG. 3
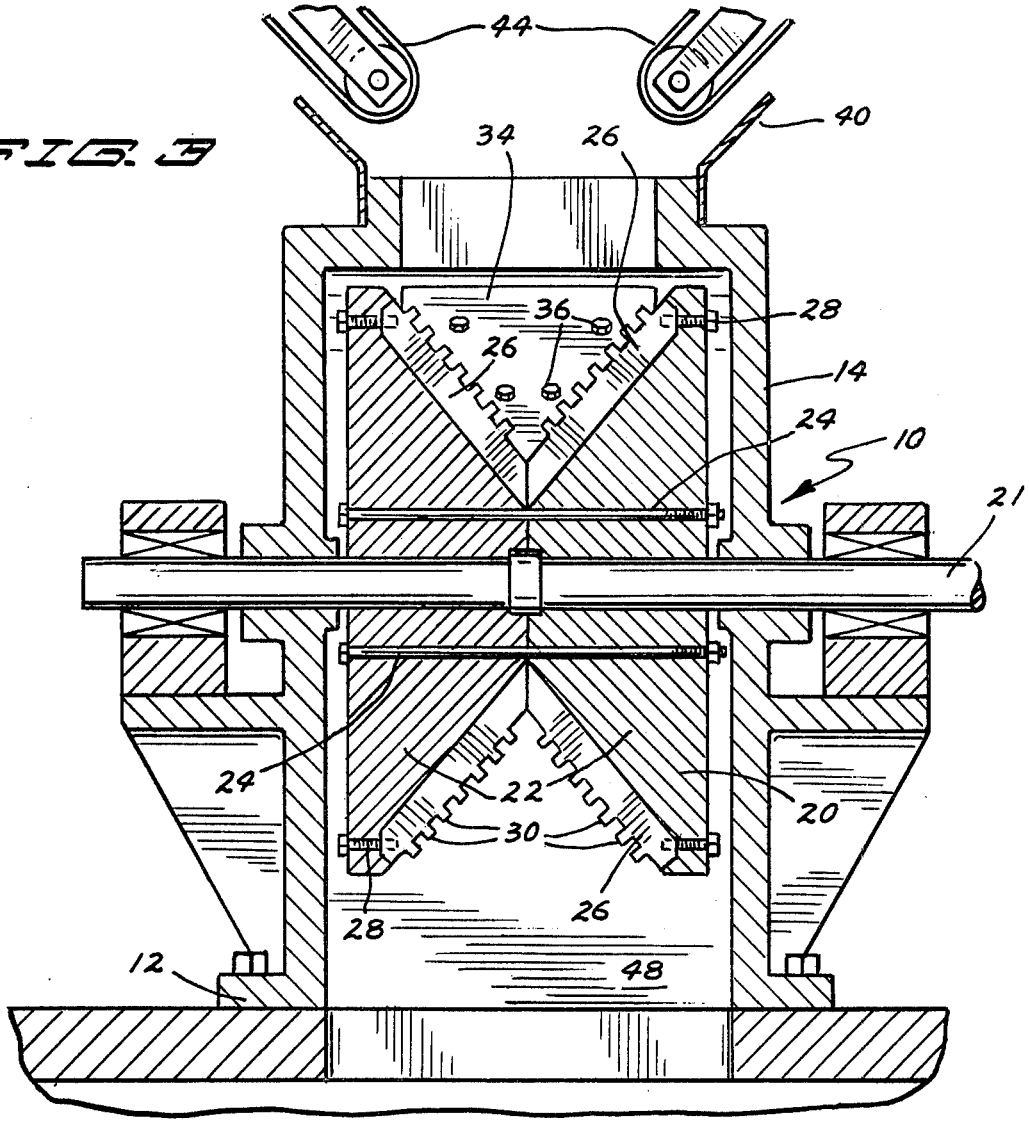
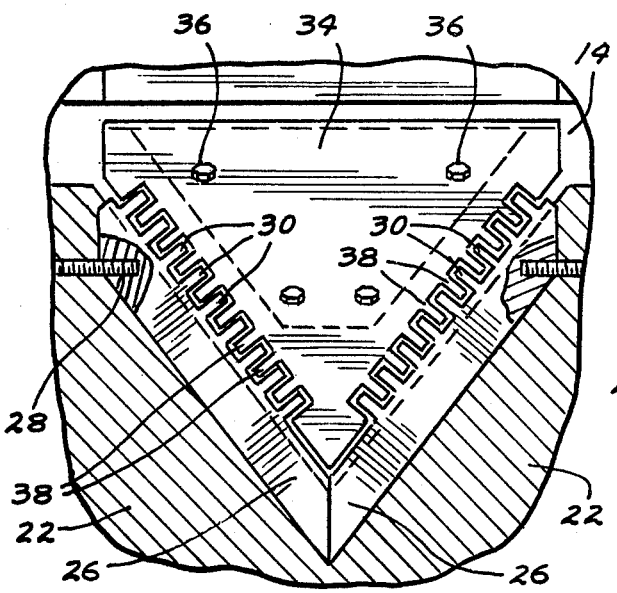
FIG. 4
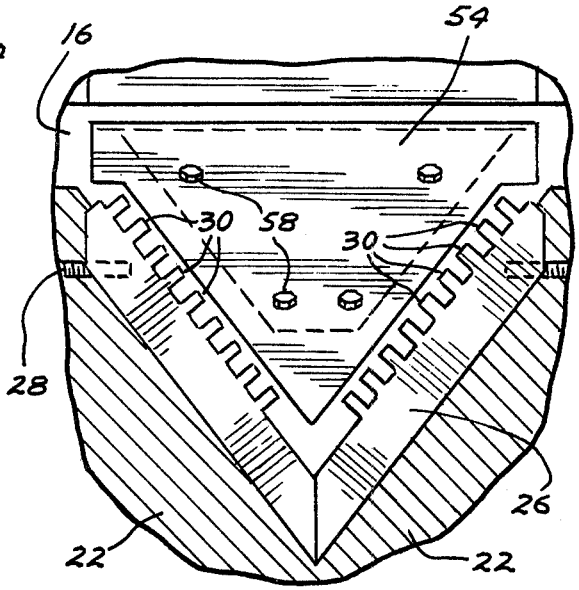
FIG. 5

MACHINE TO COMMINUTE REFUSE

BACKGROUND OF THE INVENTION

In recent years the problem of refuse disposal has been a major one. The former accepted practice of distributing refuse to dumps or even so-called "sanitary land fill sites" has resulted in utilization of large land areas for something considerably less than their optimum use. The nature of the refuse itself has presented many problems concerning the current usage of areas adjacent land fill areas and concerning the future usages of the land fill site itself.

It has been determined through experimentation that the heat value of rubbish collected within a large metropolitan area, for example, is very substantial; and it has been determined that much of the refuse thus collected can be successfully burned in installations where its heat value can be effectively utilized. As one example, it can be successfully burned in conjunction with other fuels in the process of generating steam at a steam electric plant.

A prerequisite to such utilization of refuse is the ability to economically comminute it to a particle size that can be efficiently burned. Current thinking is that particle sizes downward from one inch in maximum dimension can be economically and profitably burned.

Comminuting particular kinds of "clean" or undiluted refuse is also highly desirable so that such refuse can be successfully recycled. For example, it is desirable to comminute waste paper, fiber board and other wood fiber products preparatory to recycling the fibers in the production of paper and like products. Rubber from automobile tires can either be burned economically as set out above, or can be recycled for other purposes. Glass from used bottles and other sources can be easily handled and recycled when it is comminuted into small to fine particles.

Machines using rotors with horizontal axles and of general "hourglass" configuration have been known for a very considerable period of time for use as wood hogs. Such machines effectively turned parts of logs into wood chips. However, such machines relied on staggered or offset blades, similar to the blades on a wood planer, extending outwardly from the periphery of the rotor in position to knock or cut a chip off a solid piece of wood forced against it as the blade rotates with the rotor. These blades did not extend over the entire lineal dimension of the conical surfaces of the rotor apparently because this would have made too long a chip for the machine to have torn loose from a piece of wood resting along the entire periphery of the rotor. Also, the action was the cutting action of a knife into wood and tended to produce chips of the entire length of the solid piece of wood being pressed against the rotor at any particular point in time.

The following patents are believed to be pertinent at least in some degree:

- U.S. Pat. No. 2,195,363 to Fegley et al., granted in March of 1940;
- U.S. Pat. No. 3,610,543 to Jensen, granted in October of 1971;
- U.S. Pat. No. 2,803,410 to Boni et al., granted in August of 1957;
- U.S. Pat. No. 2,803,634 to Chayen, granted in August of 1957;
- U.S. Pat. No. 2,957,508 to Mason, granted in October of 1960; and

- U.S. Pat. No. 3,151,814 to Morgan et al., granted in October of 1964.

Applicant is not aware of any other prior art which would affect the patentability of the invention disclosed and claimed herein.

BRIEF SUMMARY OF THE INVENTION

In the form of the invention as shown, a machine to comminute refuse includes a housing, a hopper open through the housing from the top, and a drum-like rotor rotatably supported on a rotor axle in the housing at position underneath the hopper. The rotor has a plurality of shear plates mounted to rotate with it, these plates presenting spaced-apart fingers to an outer peripheral surface of the rotor. Means is provided for rotating the rotor in a first direction. An anvil in the housing provides teeth to mesh with the teeth on the shear plates and the anvil is situated inside of the housing at a side of the hopper where the shear plates will tend to carry refuse toward it. The anvil is positioned so that its teeth intermesh with the teeth on the shear plates as the shear plates rotate with the rotor.

In the form of the invention as shown, a counter-anvil is situated below the hopper at an opposite side from the anvil in position to tend to prevent refuse from passing around the rotor at the counter-anvil side thereof.

The configuration of the intermeshing fingers on the anvil and the shear plates is such that finite clearance is provided between the sides of adjacent intermeshing fingers and between the outer ends of each finger and the root area of the adjacent anvil or shear plate.

IN THE DRAWINGS

FIG. 3 is a further enlarged vertical sectional view taken on the line 3—3 in FIG. 2;

FIG. 4 is a fragmentary sectional view taken on the line 4—4 in FIG. 2, but showing the teeth of a shear plate in intermeshing relationship to the teeth of an anvil; and FIG. 5 is a fragmentary sectional view taken on the line 5—5 in FIG. 2, but showing the relationship of teeth on shear plates to a counter-anvil.

DESCRIPTION OF PREFERRED EMBODIMENT

Figure 1:
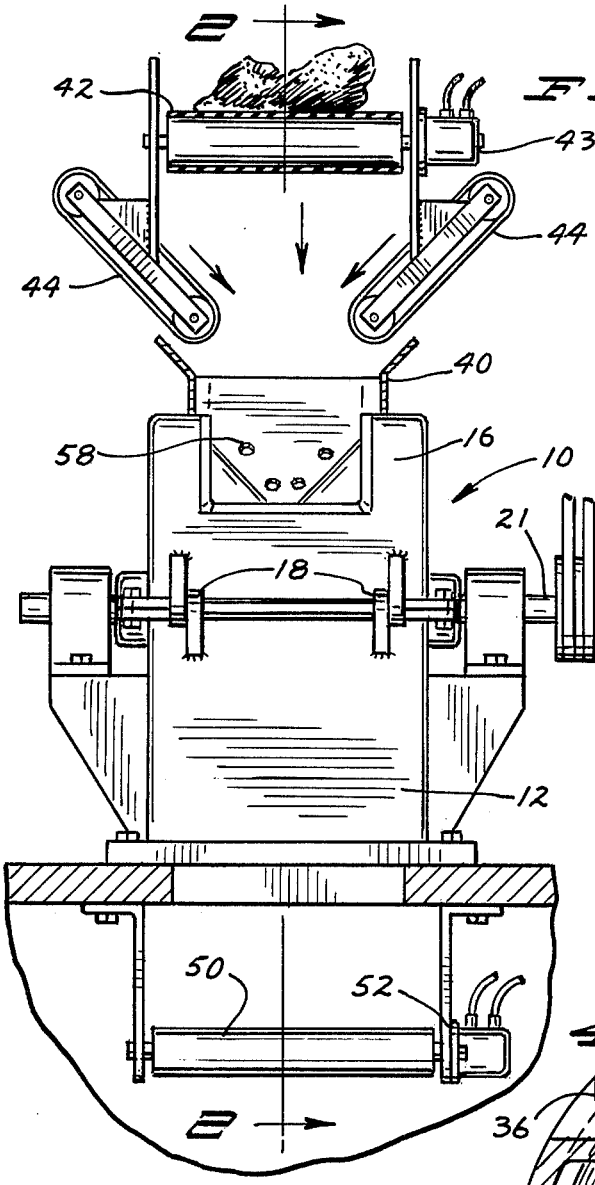
FIG. 1 is a front elevational view of a machine to comminute refuse and showing a refuse intake system for depositing refuse into the machine and a refuse discharge system for conveying comminuted refuse therefrom.

A machine 10 to comminute refuse includes a housing having main base casting 12, a first anvil-carrying top casting 14 and a second counter-anvil-carrying top casting 16, each pivotally mounted to the main casting as at 18.

A drum-like rotor 20 is mounted in the housing on rotor axle 21 and consists of two complementary discs 22,22 fastened to each other as at 24 and keyed to rotate with the axle 21. A plurality of circumferentially spaced shear plates 26 are mounted in each of the discs 22 as at 28, and each of these plates includes a plurality of spaced apart rectangular teeth 30. Means, such as a V-belt drive 32, is provided for rotating the rotor 20 and its shear plates 26 in a counterclockwise direction as seen in FIG. 2.

Figure 2:
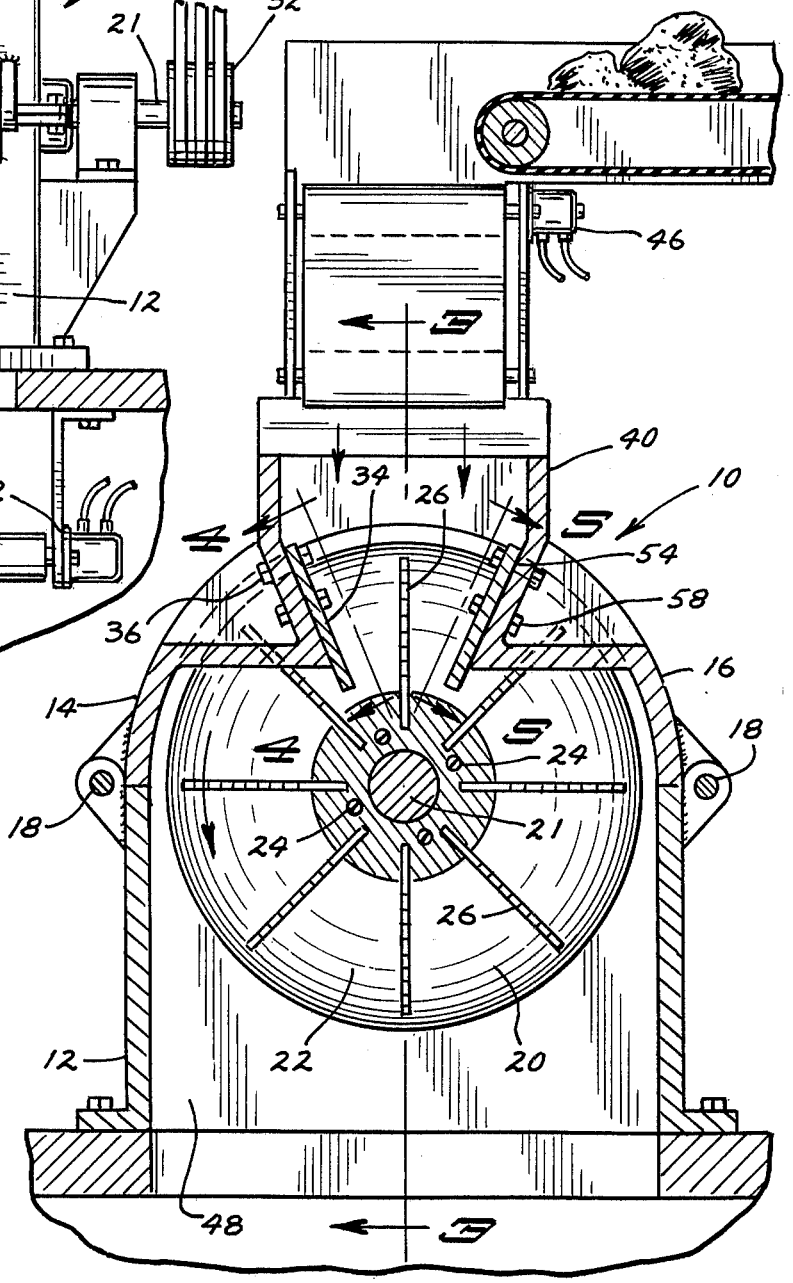
FIG. 2 is an enlarged vertical sectional view taken on the line 2—2 in FIG. 1.

As perhaps best seen in FIG. 2, an anvil 34 is fastened to first top casting 14 as at 36. The anvil is provided with a plurality of spaced-apart rectangular teeth 38 so aligned and shaped that they will mesh with and pass through the spaces between teeth 30 on each of the shear plates 26. It is unnecessary that the passing or intermeshing teeth come in contact with each other. In fact it is usually impractical to construct the parts so that the teeth touch in passing. The additional expense in holding tolerances in machining, and the danger of damage due to vibration and misalignment are not justified.

For teeth on the shear plates anvil having a width of three-eighths of an inch, a uniform spacing between these teeth of five-eighths of an inch has been found satisfactory. The width and spacing of anvilteeth will be the same. This leaves a nominal clearance of ⅛ inch between each tooth on the anvil, for example, and its immediately adjacent intermeshing tooth on the shear plate. For such teeth, it has been found satisfactory to provide for a tooth depth of one inch, with the parts being so aligned that the closest any tooth gets to the root of the space between intermeshing teeth varies between 1/16 inch and ¼ inch.

A hopper 40 forms an integral part of the two upper castings 14 and 16, and is open through those castings to the top surface of the rotor 20, as perhaps best seen in FIG. 3. Feeding into that hopper is a refuse intake feed belt 42 driven by a motor such as indicated at 43.

Directly below the discharge end of intake belt 42 and above the hopper 40 are two downwardly converging concentrating feed belts 44,44 which can be powered by motors such as shown at 46.

A discharge passageway 48 is provided through the bottom of main base casting 12, and deposits comminuted refuse on a comminuted refuse discharge belt 50 powered by a motor such as shown at 52.

A counter-anvil 54 is mounted to the second top casting 16 as at 58, and is of configuration to just clear the outer end of the teeth 30 of the shear plates as those teeth pass the counter-anvil. The purpose of this counter-anvil is to tend to prevent any discharge of the refuse entering through hopper 40 from passing around on the side of the rotor opposite the anvil 34, thus to arrive at the discharge passageway 48 without having been comminuted.

OPERATION

In FIGS. 1 and 2, rubbish to be comminuted is shown symbolically as a large lump, and such a lump or slug of rubbish is effectively and instantaneously handled by the machine of the invention. However, in more usual practice, refuse to be comminuted is spread out along a conveyor such as the intake feed belt 42 and will move very rapidly off of the discharge end of that conveyor and into the hopper 40 of the machine 10. It is advantageous to process a very high volume of refuse during any given interval of time, so sufficient refuse is fed into the hopper 40 so that there is a buildup of refuse within the machine to the point where refuse leaving the discharge end of the intake feed belt 42 actually builds up on the upper surfaces of the concentrating feed belts 44,44. The action of these belts will, then, be to concentrate and condense the refuse to remove as many air voids as possible from it, and to tend to pack it down into the hopper 40.

The action of the machine will now be described in this context, but it is to be understood that during start up, and during certain periods of use, there may or may not be sufficient refuse being fed to the machine to have it operate in this manner. Operating with less than this amount of refuse does not unduly affect the results achieved from the machine except that there tends to be more dust and finely comminuted particles flying around within the machine, out of the open hopper, and discharged through the discharge passageway of the machine under light loading than under the preferred concentrated loading described above.

With ample refuse being fed into the machine through hopper 40, and with the rotor 20 and its shear plates 26 in rapid operation, refuse coming in contact with these shear plates and their teeth 30 is carried around the periphery of the rotor until such time as they impact against the teeth 38 of the anvil 34. At this point, every piece of refuse in alignment with a tooth 30 is carried through the space between adjacent teeth 38, while that portion of the piece of refuse which contacts an anvil tooth 38 comes to a temporary stop. The mass of the rotor and the power tending to rotate the rotor causes the refuse to fracture or shear across the boundary between the moving shear plate tooth 30 and the stationary anvil tooth 38. The portion of refuse carried past the anvil in this manner by the tooth 30 is then thrown away from the tooth by centrifugal action, and falls by gravity through discharge passageway 48 in the main base casting 12 of the machine to the upper surface of comminuted refuse discharge belt 50 where it is conveyed rapidly away to a location for storage or use.

Just as it is advisable to keep the top, uncomminuted portion of the machine filled with refuse, where supplies are adequate to do so, it is also important to convey the comminuted refuse away from the bottom portion of the machine so that there is no build up in this bottom portion or main casting to the point where the shear plates can contact comminuted refuse and tend to throw it or carry it upward back into the upper portion of the machine.

In packing the upper portion of the machine with refuse through the hopper 40, it is to be expected that some of the refuse will come to rest on the counter-anvil 54, and there will be a tendency for small particles of refuse to fall past the rotor 20 on the counter-anvil side of the rotor. This tendency will be counteracted by the rapid rotation of the rotor, shear plates 26, and the teeth 30 of those shear plates. This minimizes the tendency and opportunity for refuse to pass down the "wrong side" of the rotor and into the discharge passageway 48. However, should a particle be so small that it can so pass down the "wrong way", and if it has sufficient mass to get back against the rotation of the rotor, when it is necessarily of a satisfactory size to go with the comminuted output from the machine.

It is to be understood that the faster the rotor can safely be rotated, and the greater its mass, the "easier" will be its work in comminuting the refuse presented to it. There are limits to safe speeds of rotation, of course, but a rotation of about 1200 RPM bringing the peripheral speed of an average portion of the rotor up to about 135 MPH have been found to be effective.

Because the comminuting affect is caused by the "bridging" action of one set of teeth in carrying refuse against another set of teeth, it is not necessary that the edges of either set of teeth be maintained in a critically sharpened condition. In fact, as pointed out above, at no time during the normal operation of the machine does any tooth come into contact with one of its meshing counterpart teeth, so such sharpening would have little effect.

The embodiments of the invention in which an exclusive property or privilege is claimed are defined as follows:

1. A machine to comminute refuse includes:

A. a housing;

B. a rotor rotatably mounted in said housing, said rotor being constituted as two integrally connected, face-to-face, outwardly diverging, part-conical discs;

C. a plurality of shear plates extending generally radially outwardly from each of said part-conical discs of said rotor, said shear plates each having a plurality of outwardly extending teeth lying in a radial plane which includes the axis of the rotor and said teeth extending from end to end of the longitudinal dimension of the rotor;

D. power means for causing the rotor to rotate in a first direction;

E. an intake hopper at an upper part of said housing, there being aligned openings provided between a lower portion of the hopper and an upper portion of said housing in position to permit refuse in said intake hopper to pass into said housing;

F. an anvil fixedly positioned in said housing, said anvil having a plurality of teeth situated to intermesh with the shear plate teeth as the shear plates and rotor revolve and rotate in the housing, said anvil teeth extending from end to end of the longitudinal dimension of the rotor, said anvil being below said intake hopper and at a side thereof to receive refuse carried toward it by said shear plate teeth; and G. said housing being provided with a discharge passageway in position to receive comminuted refuse passing between said rotor and said anvil.

2. The machine of claim 1 wherein said intermeshing shear plate and anvil teeth pass in clearing and slightly spaced relation to each other.

3. A machine to comminute refuse includes:

A. a housing;

B. a rotor rotatably mounted in said housing, said rotor being constituted as two integrally connected, face-to-face, outwardly diverging, part-conical discs;

C. a plurality of shear plates extending generally radially outwardly from each of said part-conical discs of said rotor, said shear plates each having a plurality of outwardly extending teeth lying in a radial plane which includes the axis of the rotor;

D. power means for causing the rotor to rotate in a first direction;

E. an intake hopper at an upper part of said housing, there being aligned openings provided between a lower portion of the hopper and an upper portion of said housing in position to permit refuse in said intake hopper to pass into said housing;

F. an anvil fixedly positioned in said housing, said anvil having a plurality of teeth situated to intermesh with the shear plate teeth as the shear plates and rotor revolve and rotate in the housing, said anvil being below said intake hopper and at a side thereof to receive refuse carried toward it by said shear plate teeth;

G. said housing being provided with a discharge passageway in position to receive comminuted refuse passing between said rotor and said anvil; and H. a counter-anvil fixedly positioned in said housing, said counter-anvil having an outer edge surface terminating closely adjacent to but slightly spaced from the shear plate teeth as the shear plates and rotor revolve and rotate in the housing, said counter-anvil being below said intake hopper and at a side thereof opposite said anvil to be in position to tend to block refuse from passing around said rotor in direction opposite first direction.

4. The machine of claim 3 wherein said shear plate teeth and said anvil teeth extend from end to end of the longitudinal dimension of said rotor.

* * * * *